US007100320B2

(12) United States Patent
Verdugo

(10) Patent No.: US 7,100,320 B2
(45) Date of Patent: Sep. 5, 2006

(54) RETICULE

(76) Inventor: Edward A. Verdugo, P.O. Box 1246, Yucaipa, CA (US) 92399

( * ) Notice: Subject to any disclaimer, the term of this patent is extended or adjusted under 35 U.S.C. 154(b) by 381 days.

(21) Appl. No.: 10/708,288

(22) Filed: Feb. 23, 2004

(65) Prior Publication Data

US 2005/0188601 A1 Sep. 1, 2005

(51) Int. Cl.
*F41G 1/08* (2006.01)
*F41G 1/12* (2006.01)

(52) U.S. Cl. ..... 42/130; 42/113; 42/131; 42/133; 42/145; 33/297

(58) Field of Classification Search ..... 42/113, 42/135, 130, 139, 131, 144, 133, 145; 33/265, 33/297, 284
See application file for complete search history.

(56) References Cited

U.S. PATENT DOCUMENTS

| | | | | | |
|---|---|---|---|---|---|
| 189,721 | A | | 4/1877 | Freund | 33/243 |
| 451,499 | A | * | 5/1891 | Marble | 42/135 |
| 912,050 | A | | 2/1909 | Wanee | 33/243 |
| 1,088,137 | A | | 2/1914 | Fidjeland | 356/50 |
| 1,190,121 | A | | 7/1916 | Critchett | 33/245 |
| 2,420,273 | A | | 5/1947 | West | 88/65 |
| 2,613,442 | A | * | 10/1952 | Austin | 42/139 |
| 3,190,003 | A | | 6/1965 | O'Brien | 33/50 |
| 3,392,450 | A | | 7/1968 | Herter et al. | 33/50 |
| 3,782,822 | A | | 1/1974 | Spence | 356/21 |
| 3,820,248 | A | * | 6/1974 | Hayward | 42/145 |
| 3,948,587 | A | | 4/1976 | Rubbert | 356/21 |
| 4,263,719 | A | | 4/1981 | Murdoch | 33/297 |
| 4,618,221 | A | | 10/1986 | Thomas | 350/566 |
| 4,957,357 | A | | 9/1990 | Barns et al. | 350/576 |
| 5,065,538 | A | * | 11/1991 | Allen | 42/142 |
| 5,148,603 | A | * | 9/1992 | Beutler | 33/265 |
| 5,491,546 | A | * | 2/1996 | Wascher et al. | 356/4.03 |
| 6,058,921 | A | | 5/2000 | Lawrence et al. | 124/87 |
| 6,445,497 | B1 | | 9/2002 | Adda | 359/428 |
| 6,560,884 | B1 | * | 5/2003 | Afshari | 33/265 |
| 6,591,537 | B1 | | 7/2003 | Smith | 42/122 |
| 6,681,512 | B1 | | 1/2004 | Sammut | 42/122 |
| 6,729,062 | B1 | * | 5/2004 | Thomas et al. | 42/122 |

FOREIGN PATENT DOCUMENTS

EP 0 188 684 A2 * 7/1986

* cited by examiner

*Primary Examiner*—Stephen M. Johnson
(74) *Attorney, Agent, or Firm*—Geoffrey E. Dobbin

(57) ABSTRACT

The present invention is a reticule featuring both rapid close quarters target acquisition and precise distance shooting functionality. The reticule features a broad central aiming ring and four sets of aiming point indicating dots. The lowest set comprises dots of differing dimensions and distances apart. Ranging rings are also provided. An alternate embodiment is also comprises a highlighting ring around the aiming ring. The reticule can be illuminated through known or future discovered means for low-light or night shooting.

14 Claims, 2 Drawing Sheets

(c) 2003 Ed Verdugo (c) 2003 Ed Verdugo (c) 2003 Ed Verdugo

RETICULE

COPYRIGHT STATEMENT

A portion of the disclosure of this patent document contains material which is subject to copyright protection. The copyright owner has no objection to the facsimile reproduction by anyone of the patent disclosure as it appears in the Patent and Trademark Office patent files or records, but otherwise reserves all copyright rights whatsoever.

BACKGROUND OF INVENTION

1. Field of Invention

The present invention relates to the field of reticules, and more particularly relates to a reticule for a telescopic sight system while being useful in both rapid target acquisition in close quarters combat and precise distance shooting situations.

2. Background of the Invention

Reticules are well known in the prior art. They are used in any situation where aiming any type of device is necessary, ranging from medical devices to weapons. Reticule types range from the traditional "crosshairs" to dots, circles, other geometric shapes, movable cross lines or any combination of the above. For example, U.S. Pat. No. 6,681,512 (2004) to Sammut; U.S. Pat. No. 6,591,537 (2003) to Smith; U.S. Pat. No. 6,453,595 (2002) to Sammut; U.S. Pat. No. 6,357,158 (2002) to Smith, III; U.S. Pat. No. 6,058,921 (2000) to Lawrence, et al.; U.S. Pat. No. 4,957,357 (1990) to Barnes, et al.; U.S. Pat. No. 4,618,221 (1986) to Thomas; U.S. Pat. No. 4,263,719 (1981) to Murdoch; U.S. Pat. No. 3,948,587 (1976) to Rubbert; U.S. Pat. No. 3,782,822 (1974) to Spence; U.S. Pat. No. 3,392,450 (1968) to Herter, et al.; U.S. Pat. No. 2,420,273 (1944) to West; U.S. Pat. No. 1,190,121 (1916) to Critchett; U.S. Pat. No. 1,088,137 (1914) to Fidjeland; U.S. Pat. No. 912,050 (1909) to Wanee; and U.S. Pat. No. 189,721 (1877) to Freund are all illustrative of the prior art.

While the aforementioned inventions accomplish their individual objectives, they do not describe a reticule that is useful for both rapid close range target acquisition and precision shooting at a distance. In this respect, the reticule according to the present invention departs substantially from the usual designs in the prior art. In doing so, this invention provides a simple reticule using an aiming point strategy in its design and functionality. The reticule according to the present invention also incorporates a plurality of aiming points represented as dots of different scales to facilitate use at various ranges, from 10 to 600 yards or beyond. Prior reticules attempt to compensate for drop of a bullet over distance by increasing the distance between provided reticule guidelines. The reticule according to the present invention does not attempt to do so. In the present invention, a set of smaller scale dots provides a reference point for a shooter to use after practicing with a particular weapon over time, thereby avoiding problems of translating the results of "average" weapons to a particular weapon. Simultaneously, the reticule according to the present invention covers less of a target area, decreasing uncertainty and having a corresponding increase in hit potential.

SUMMARY OF INVENTION

In view of the foregoing disadvantages inherent in the known types of reticule, this invention provides an improved reticule with varying scales for use in multiple range environments. As such, the present invention's general purpose is to provide a new and improved reticule that will allow a user to improve accuracy and time at a distance without being a hindrance at close range.

To accomplish this goal and still maintain a utility derived from simplicity, the reticule according to the present invention comprises a main aiming ring with a series of aiming dots extending from the ring in what would be considered the cardinal directions. The aiming ring is utilized for speed and accuracy in close targeting scenarios, providing a broad, easily identifiable aiming point. The "southern" portion of the targeting ring is empty, allowing for a series of aiming dots to extend from the center of the ring to the bottom of the reticule. As the southern dots extend from the ring, they gradually are reduced in size and are spaced at a lesser distance apart. Thin reference rings are positioned towards the bottom of the reticule for range estimation. The reticule may be made of a luminous material, or may be electronically or chemically induced to glow for night and low light use.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
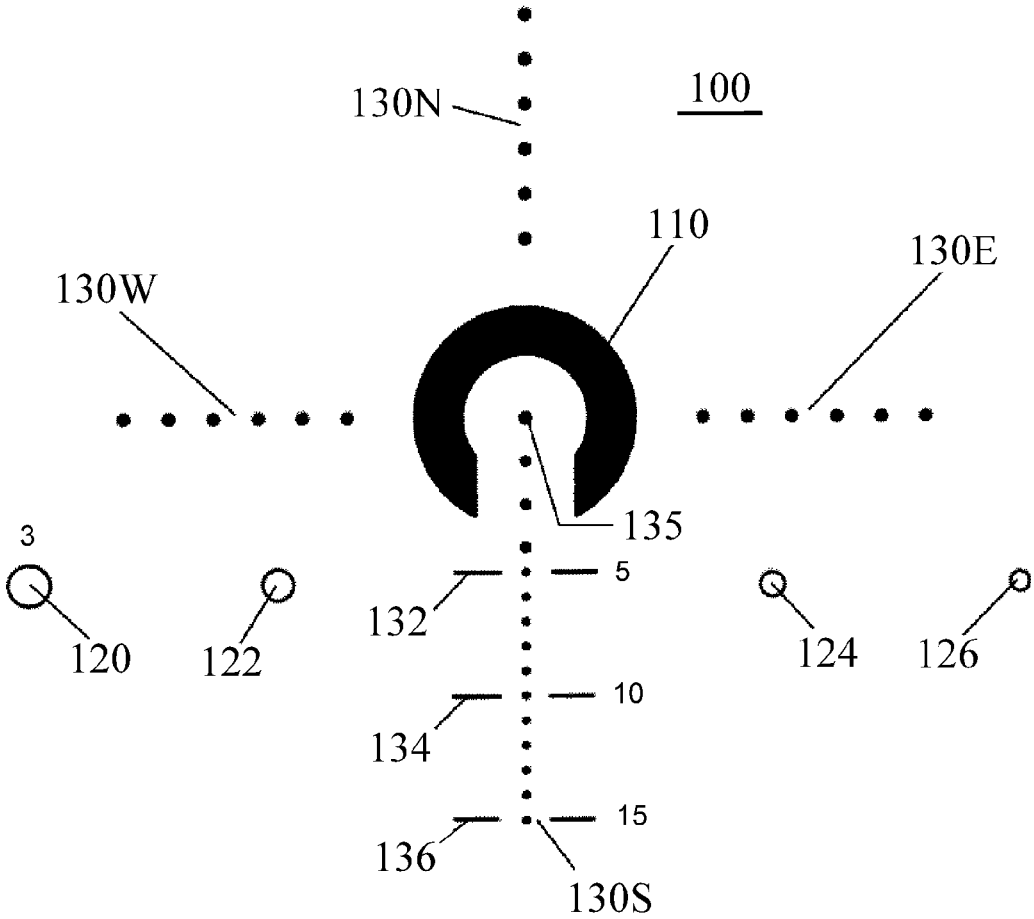
FIG. 1 is a plan view of the reticule according to the present invention.

With reference now to the drawings, the preferred embodiment of the reticule is herein described. Referring specifically to FIG. 1, reticule 100 is has a central aiming ring 110, a plurality of varying sized ranging rings 120, 122, 124, 126, and four sets of dots in linear patterns defining four cardinal directions, 130N, 130S, 130E, 130W.

Figure 2:
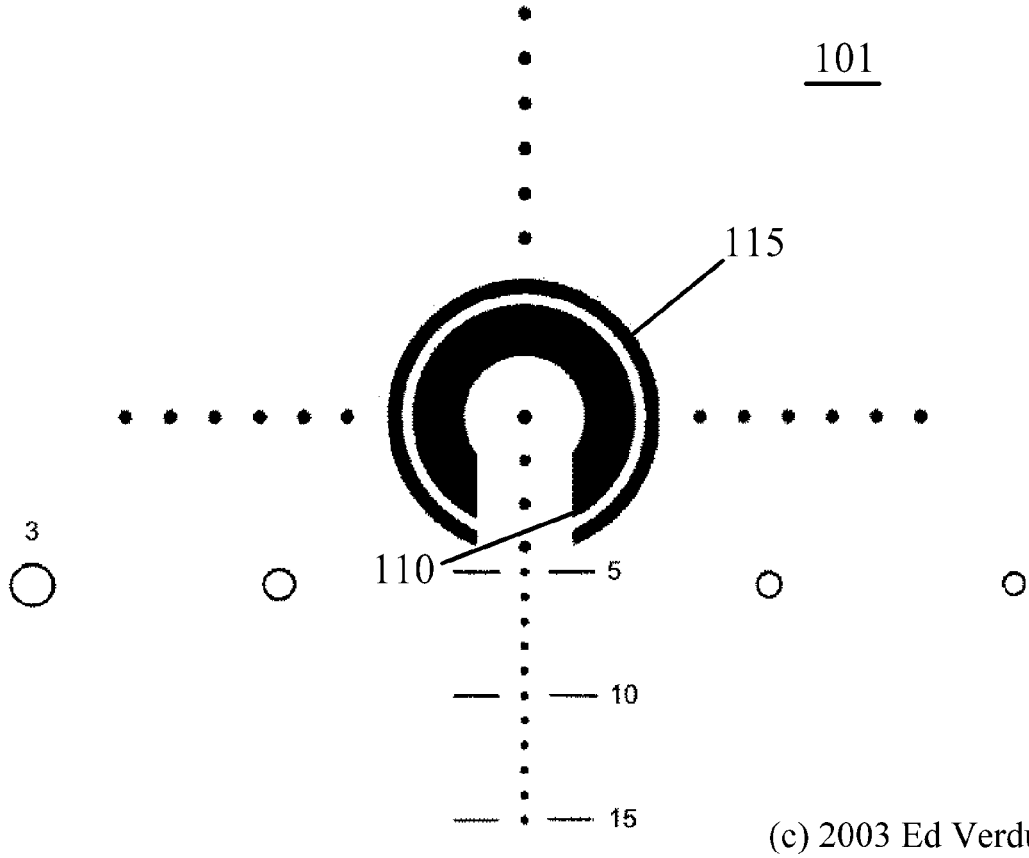
FIG. 2 is a plan view of an alternate embodiment of the reticule.

Throughout this application and in the claims, the term "dot" is used to define an indicator of the location of generic aiming points on the reticule. The term "dot" may be used of indicators of any shape, such as triangles, crosshairs, ovals and rectangles, and need not necessarily be circles. Aiming ring 110 is not a complete ring, as it is open towards the southern direction. Dot set 130S initiates in the center of the reticule with central aiming point 135 and is comprised of dots of three different sizes and two different spacing intervals, as shall be described later in this specification. Labeled quick count lines 132, 134, 136 may be provided at any interval, though the shown preferred embodiment is an interval of 5. Ranging ring 120 is labeled "3" on the reticule. Alternate reticule embodiment 101, shown in FIG. 2 also comprises a highlighting ring 115, bordering aiming ring 110 and also open in the southern direction.

The utility of the reticule 100 is found in the set spacing and sizes of the individual components relative to each other. The reticule uses the same basic perspective principles used in other ranging reticules, that is that objects appear smaller the further they are away from a viewer.

Aiming ring 110 has a thickness of 4 Minutes Of Angle ("MOA"). 1 MOA is roughly equivalent to 1 inch at 100 yards. Its diameter is 18 MOA, leaving a 10 MOA window interior. When highlighting ring 115 is used, it has a thickness of 1 MOA and is 1 MOA distant from the outer boarder of aiming ring 110, for a total diameter of 22 MOA. Each of the dots in directional sets 130N, 130E, and 130W are 0.75 MOA, and the central aiming point 135 is 1 MOA. The next highest dots in set 130S are 0.75 MOA. Each of these dots have an interval spacing of 3.5 MOA. Staring with the dot labeled "5" in the southern set 130S, the remaining dots are 0.5 MOA and have an interval spacing of 2 MOA. Ranging rings 120, 122, 124, 126 have diameters of 3.33 MOA, 2.5 MOA, 2 MOA, and 1.67 MOA respectively. To maintain proper perspective of relative sizes of the reticule components with potential targets, the reticule should be positioned either on or next to the objective lens of any telescopic sighting devices, thereby magnifying the reticule in the same power as the target and maintaining proportion.

In use, the reticule according to the present invention provides a rapidly identified aiming point in close quarters combat situations, as the reticule provides an easily identified center target with aiming ring 110. This is especially true if the sighting device is set at zero magnification, thus diminishing all other reticule components from view. The reticule also provides ranging capability for more accurate distance shooting. Aiming ring 110 and ranging rings 120, 122, 124, and 126 are set to measure the equivalent of 10-inch targets at 100, 300, 400, 500, and 600 yards distance. Central aiming point 135 is the center of aiming ring 110 and therefore defines the diameter of a 5 MOA circle with any single point within the inner part of the aiming ring 110. This corresponds to a 10-inch target at 200 yards. While the four ranging rings are provided in the preferred embodiment, more or fewer rings may be employed in the practice of this invention. Likewise, different shapes may also be used, though in all embodiments the shapes should be mere outlines, allowing a user to see past the shape.

For distance shooting, it is important to consider the drop of a bullet over distance. The amount of drop will be determined by a number of factors, including barrel length, rifling, bullet weight, charge of ammunition, etc. Together, these factors are called a "package"and are usually uniform over time for a user's weapon. The scope can be zeroed so that the central aiming point 135 represents where a bullet will hit at 200 yards. Once this is set, a user merely practices with his or her particular weapon package to determine at which dot in the southern set 130S a bullet will hit at specified yardage. Since the lower portion of southern set 130S is used in distance shooting, the dots are smaller and the distance between them is smaller, so that less of a target is covered by a dot at greater distance from the shooter. With less of a target covered, there is greater accuracy in the shooting due to less uncertainty as to the actual spot where the bullet will hit. In the present embodiment, a 0.5 MOA dot will cover only 3 inches of a target at 600 yards. The distance between the dots in the lower range is 2 MOA, corresponding to 12 inches at 600 yards. The central aiming dot 135 would cover 6 inches at 600 yards, presenting double the uncertainty and a corresponding drop in accuracy.

Through practice, a user may note where a bullet will hit on the reticule at a determined distance. Afterwards, when a user picks a target of a known size, comparisons are made with ranging rings 120, 122, 124, and 126, as well as with the interior of aiming ring 110, to determine distance. When aiming at the target, the user merely picks the appropriate aiming point from the dots in set 130S and fires, hitting the target. The preferred embodiment attaches no external significance to the aiming points represented by the dots, unlike various other prior art reticules which attempt to compensate for the amount of drop a bullet will have over distance. The importance of the smaller dots and smaller distance between them is for better accuracy with a particular weapon. Remaining dot sets 130N, 130E, 130W are ideally set to a uniform standard, for instance the standard military dot ranging system, and are useful as guides for windage and canting calculations and for ranging in horizontal and vertical planes.

In low light situations, the reticule may be illuminated through conventional, or to be discovered, means. Ideally, ranging rings 120, 122, 124, 126, dots sets 130N, 130S, 130E, 130W, and aiming ring 110 would have illumination capability. Highlighting ring 115 is used in those situations where illumination of the central aiming ring 110 is difficult or impossible.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A reticule comprising:

a. A central aiming ring of significant thickness and having a center, said ring having an incomplete perimeter on a bottom side of the ring; and b. at least one set of guide dots, with at least one of the sets originating in the center of the aiming ring with a central aiming dot and said set of guide dots extending through the incomplete perimeter of the aiming ring into an area external of the aiming ring, wherein, each set of guide dots is arranged as a series of dots, each pair of adjacent dots having an interstitial spacing, extending in a straight linear fashion and each dot represents a generic aiming point.

2. The reticule of claim 1, the set originating from the center of the aiming ring being comprised of at least two different sized dots, with larger dots being positioned near the center of the reticule.

3. The reticule of claim 2, wherein of the dots only the central aiming dot has any attached significance external the reticule.

4. The reticule of claim 1, further comprising at least one ranging system.

5. The reticule of claim 4, wherein a ranging system is a set of at least one ranging rings.

6. The reticule of claim 1, further comprising an illumination means.

7. The reticule of claim 1, wherein the central aiming ring is approximately four tines thicker than the central aiming dot.

8. The reticule of claim 1, further comprising a highlighting ring circumscribing the aiming ring.

9. The reticule of claim 1, further comprising at least one reference line indicating an ordinal position of at least one dot in the set of dots originating from the center of the reticule.

10. The reticule of claim 1, the interstitial spacing between dots being smaller for pairs of dots furthest from the center dot than for a pair of dots including the central aiming dot.

11. The reticule of claim 1, wherein there is are four sets of guide dots, each defining a cardinal direction and the set extending in the southern direction is the set originating from the center.

12. The reticule of claim 11, the set originating from the center of the aiming ring being comprised of at least two different sized dots, with larger dots being positioned near the center of the reticule.

13. The reticule of claim 12, wherein of the dots only the central aiming dot has any attached significance external the reticule.

14. The reticule of claim 11, wherein the sets of dots, except the set containing the central aiming dot, conform to a standard scale.

* * * * *